United States Patent [19]

Usui

[11] Patent Number: 4,913,119

[45] Date of Patent: Apr. 3, 1990

[54] FUEL DELIVERY RAIL ASSEMBLY

[75] Inventor: Masayoshi Usui, Numazu, Japan

[73] Assignee: Usui Kokusai Sangyo Kaisha Ltd., Shizuoka, Japan

[21] Appl. No.: 387,962

[22] Filed: Aug. 1, 1989

[30] Foreign Application Priority Data

Aug. 3, 1988 [JP] Japan ..... 63-102437[U]

[51] Int. Cl.[4] ..... F02M 39/00

[52] U.S. Cl. ..... 123/456; 123/468; 123/470

[58] Field of Search ..... 123/456, 468, 469, 470, 123/471, 472; 239/600; 285/173, 174, 130, 238, 239; 138/108; 137/561 A

[56] References Cited

U.S. PATENT DOCUMENTS

| | | | |
|---|---|---|---|
| 3,929,109 | 12/1975 | Chamberlain | 123/468 |
| 3,930,483 | 1/1976 | Blisko | 123/468 |
| 4,290,394 | 9/1981 | Frank | 123/472 |
| 4,334,512 | 6/1982 | Biernath | 123/469 |
| 4,457,280 | 7/1984 | Hudson, Jr. | 123/470 |
| 4,844,036 | 7/1989 | Bassler | 123/456 |

FOREIGN PATENT DOCUMENTS

| | | | |
|---|---|---|---|
| 0150070 | 9/1983 | Japan | 123/470 |

*Primary Examiner*—Carl Stuart Miller

*Attorney, Agent, or Firm*—Wenderoth, Lind & Ponack

[57] ABSTRACT

A fuel delivery rail assembly for supplying fuel to a plurality of fuel injectors in an engine is provided. The assembly comprises a plurality of sockets made from plastic materials and a plurality of rail sections made by metallic materials extending from the sockets. Each of the sockets includes a tubular body and a pair of extension pipes extending outwardly from the body toward opposite directions. Interior surfaces of the tubular body are so formed as to receive a fuel injector. At least one end of each rail section is overlapped above or below the extension pipe with a seal member therebetween while being combined by an appropriate connection.

3 Claims, 3 Drawing Sheets

FUEL DELIVERY RAIL ASSEMBLY

BACKGROUND OF THE INVENTION

This invention relates to a fuel delivery rail assembly for an internal combustion engine, especially for an automotive engine, equipped with a fuel injection system. The fuel delivery rail assembly delivers pressurized fuel supplied from a fuel pump toward intake passages or chambers via associated fuel injectors. The assembly is used to simplify installation of the fuel injectors and the fuel supply passages on the engine.

An example of an automotive engine cylinder head equipped with a fuel injector is shown in FIG. 5 of the attached drawings. In this cylinder head, toward inside of an intake manifold 52 leading to a cylinder 51, pressurized fuel is discharged from a fuel injector 55. The fuel delivery rail assembly 60, which concerns a substantial matter of the present invention, is only partially shown as a section of a socket 61. In this type of fuel delivery rail assembly, the injector 55 is accommodated within the socket 61 and fixed thereto by a cap 66 having an electrical terminal. Between the injector 55 and the socket 61, two 0-rings 58 and 59 are located in order to keep fluid tight seals therebetween.

A complete form of the fuel delivery rail assembly 60 is shown in FIG. 6. In this assembly 60, three tubular sockets 61 are interconnected by connecting pipes 62. Each of the sockets 61 is located at a predetermined distance from each other. These metallic sockets 61 are initially made through a forging process, and then directed to a precise machining work. In this step, especially interior surfaces of the socket should be smoothly finished in order to establish a fluid tight seal of O-ring. For this purpose, a special machining process of burnishing work is commonly utilized to effect a high grade of circumferential accuracy as well as surface smoothness.

Each socket 61 comprises a tubular body 63 having a top opening, a bottom opening and two lateral openings facing opposite directions. These lateral openings are used to receive distal ends of the connecting pipes. By means of brazing connections 64, the sockets 61 and the pipes 62 are fixed together. On upper flange of the tubular body 63 of the socket 61, a pair of extensions 65 having threaded holes are provided so as to receive the cap 66 (see FIG. 5) and to be bolted together.

Since the conventional fuel delivery rail assembly is constructed as stated above, many kinds of workings are necessary for manufacturing of the assembly. In particular, the interior surfaces of the socket 61 should be finished extremely smooth in order to establish a complete fluid seal between the surface and the resilient seal members and also to avoid breakdown of the seal members, because they are mounted on the injector 55 when it is inserted into the socket 61. The following steps are needed in manufacturing of the socket 61. At first a rough fabrication is made by a forging work, and then it is machined to make a form of the interior surface. Finally, the socket is finished with a burnishing machine until the predetermined smoothness is obtained. Under the situation, for manufacturing of the socket 61, many kinds of time-consuming working steps and transferring handlings are needed, resulting in an increase of manufacturing cost.

SUMMARY OF THE INVENTION

It is an object of the present invention to overcome the above disadvantages in producing the fuel delivery rail assembly and to reduce the number of working steps.

Another object of the present invention is to provide an economical fuel delivery rail assembly.

A further object of the present invention is to provide a lightweight fuel delivery rail assembly so as to reduce a resultant weight of an automotive engine.

Still further object of the present invention is to overcome alignment problems in mounting of the fuel delivery rail assembly to an engine.

According to the invention, there is provided a fuel delivery rail assembly for an internal combustion engine comprising; a plurality of sockets made from plastic materials, a plurality of rail sections made by metallic materials extending from said sockets, each of said sockets having a tubular body and a pair of extension pipes extending outwardly from the body toward opposite directions, interior surfaces of said tubular body being so formed as to receive a fuel injector, at least one end of each rail section being overlapped above or below said extension pipe with a seal member therebetween, and means for combining said rail sections and said extension pipes.

Within the scope of the invention, each socket is made from plastic materials so as to meet a required shape and surface smoothness through an injection moulding process utilizing a metallic die. Thus, a smooth inside surface suitable for receiving a body of an injector can be obtained easily, without need of complicated forging and machining process. Since the overlapping connections between the sockets and the rail sections provide flexible engagements, assembling process is considerably simplified and there is no need of strict limitation about a dimensional accuracy or geometrical orientation of the parts. Since the socket is made from lightweight plastic materials, its weight becomes relatively lighter than that of the conventional integral metallic socket. Thus, it can help to reduce the resultant weight of the fuel delivery rail assembly, thereby facilitating a reduction of the engine weight.

As a further advantage of the present invention, it can provide a practical solution to the alignment problem between the socket and the injector, since there remains a flexibility for the axial direction of the socket.

In a preferable embodiment of the invention, the socket is made from a glass-fiber reinforced polyamide resin and its surface is plated with nickel coating for the purpose of resisting against high temperature and gasoline fuel.

The means for combining the rail sections and the extension pipes are effected by many kinds of mechanical fittings and the like.

Other features and advantages of the invention will become apparent from a reading of the specification, when taken in conjunction with the drawings, in which, like reference numerals refer to like elements in the several views.

DESCRIPTION OF THE PREFERRED EMBODIMENT

Figure 1:
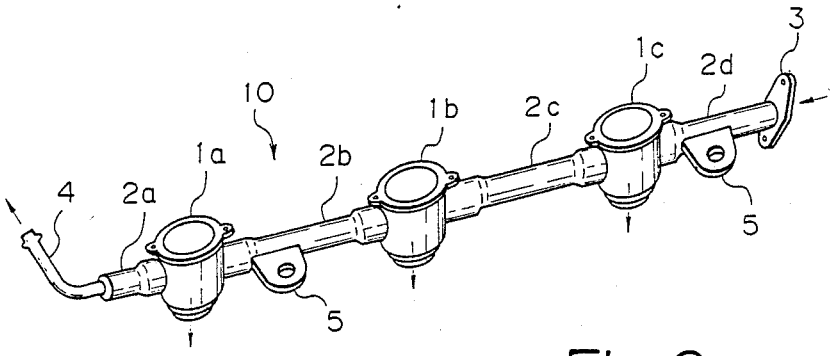
FIG. 1 is a perspective view of the fuel delivery rail assembly according to the invention.

Referring to FIG. 1, there is shown a fuel delivery rail assembly 10, a preferable embodiment of the present invention, which is adapted to three cylinders on one side of an automotive V-6 engine. This assembly 10 comprises three sockets 1*a*, 1*b* and 1*c* made from plastic materials, an outlet rail section 2*a*, a first intermediate rail section 2*b*, a second intermediate rail section 2*c*, and an inlet rail section 2*d*. Every rail section is made from metallic materials such as steel tubes. Each socket is located at a predetermined distance from each other. To an outer end of the inlet rail section 2*d*, a flange 3 is fixed so as to combine with a pressure regulator or any other part leading to a fuel pressurizing pump, and to an outer end of the outlet rail section 2*a*, a joint pipe 4 is fixed so as to receive a rubber hose. All of these parts are connected to keep fluid communication therethrough. In this assembly, gasoline fuel is supplied from the fuel pressurizing pump to a fuel passage arranged within the flange 3 leading to the inlet rail section 2*d*. Most of the fuel supplied to the rail sections 2*a*, 2*b*, 2*c* and 2*d* is discharged through the sockets 1*a*, 1*b* and 1*c* toward respective fuel injectors, and remaining fuel is carried through the joint pipe 4 to another fuel delivery rail assembly on the other side of the V-6 engine. Residual fuel is finally carried back to a fuel tank. To the lateral sides of the intermediate rails 2*b* and 2*c*, rigid brackets 5 are fixed so as to mount the assembly 10 on the engine.

Figure 2:
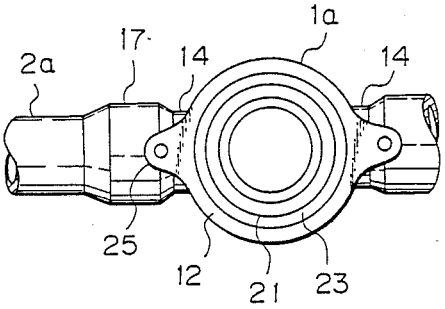
FIG. 2 is a top plan view illustrating a connecting relationship between a socket and adjacent rail sections.
Figure 3:
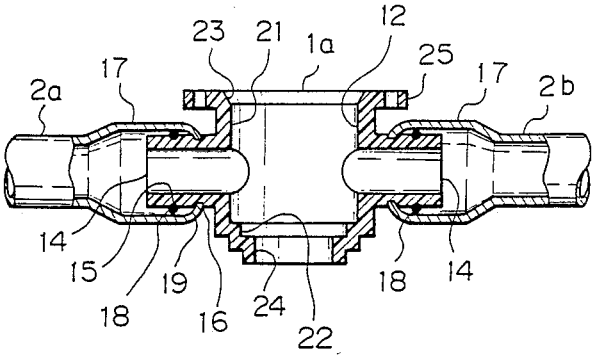
FIG. 3 is a vertical sectional view illustrating an internal connecting relationship of the portion in FIG. 2.

FIGS. 2 and 3 illustrate connecting relationships between the socket 1*a* and adjacent rail sections 2*a* and 2*b*. As typically shown in these figures, each socket comprises a tubular body 12 and a pair of extension pipes 14 extending outwardly from the body toward opposite directions. The interior surfaces 21, 22, 23 and 24 of the tubular body 12 are so formed as to receive a body of a fuel injector. The socket 1*a* is integrally made from plastic materials such as polyether-imide (PEI) resin or polyamide (PA) resin having superior properties of heat-resistance and fuel-resistance, through an injection moulding process utilizing a metallic die. Thus, the interior surfaces are finished to obtain a required surface smoothness. On outer periphery of the extension pipe 14, an O-ring groove 15 and an annular slot 16 are provided. Each end portion 17 of the rail sections 2*a* and 2b is formed into an enlarged configuration with an edge adapted to be shrinked into engagement with the slot 16. After an O-ring 18 is set into the groove 15, the edge of the end portion 17, passing over the O-ring 18, is mechanically shrinked into a neck 19 for engagement with the slot 16. Before the edge is shrinked it is preferable to apply an adhesive agent to a gap between the slot and the edge. Thus, the extension pipes 14 and the rail sections 2*a* and 2*b* are overlapped and combined in fluid tight communication together with the intermediate O-rings 18. Any other seal members such as seal rings or gaskets can be substituted for the O-rings.

Figure 5:
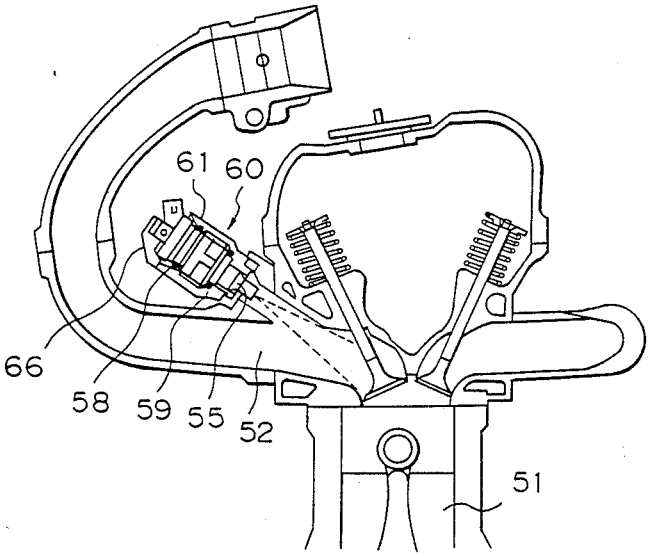
Fig. 5 PRIOR ART
FIG. 5 is a schematic sectional view of a fuel injection type engine, illustrating a mounting relationship between the fuel delivery rail assembly, injector and intake manifold.
Figure 6:
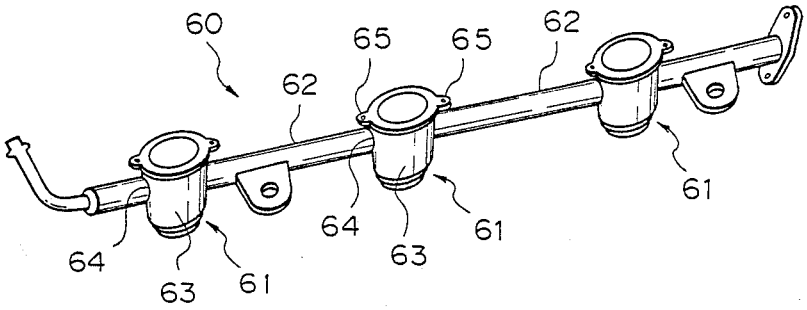
Fig. 6 PRIOR ART
FIG. 6 is a perspective view of the conventional fuel delivery rail assembly in FIG. 5.

Inside of the socket 1*a*, are provided smooth interior surfaces 21 and 22 for receiving a body of the injector 55 having O-rings 58 and 59 thereon, a conical cut end surface 23 at the top opening, and a stepped bottom opening surface 24. On upper flange of the tubular body 12 of the socket 1*a*, a pair of extensions 25 having threaded holes are provided so as to receive the cap 66 (see FIG. 5) after accommodating the injector 55 therein. Thus, in the same manner as the existing metallic socket, this plastic socket 1*a* can accommodate the injector 55 and accomplish fluid tight sealings by the O-rings 58 and 59.

Figure 4:
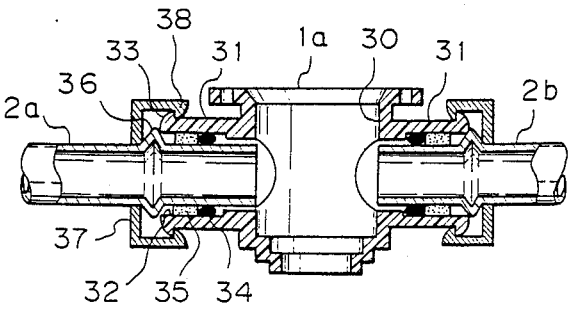
FIG. 4 is a vertical sectional view illustrating an alternative embodiment of the connection between the socket and adjacent rail sections.

FIG. 4 shows an alternative embodiment of the connecting relationships between the socket 1*a* and the rail sections 2*a* and 2*b*. In this embodiment, on an interior surface of an extension pipe 31 extending from a body 30 of the socket 1*a*, an enlarged bore 32 is provided, and at an outer edge of the extension pipe 31, an outwardly enlarged rib 33 is provided. On the other hand, the rail section 2*a* is provided with an outwardly extended corrugation 36 which is so formed as to abut with the edge of the extension pipe 31. A clamp ring 37 holds the corrugation 36 and the rib 33 in its inside by means of an inwardly extending hook 38. Fluid tight sealings between the extension pipe 31 and the overlapped end of the rail section 2*a* are accomplished by a resilient O-ring 34 and a back up ring 35.

The assembling operation of the embodiment shown in FIG. 4 is as follows: At first the back up ring 35 and the O-ring 34 are set over the inner end of the rail section 2*a*. Then, the inner end of the section 2*a* is inserted into the enlarged bore 32. When the corrugation 36 comes into contact with the edge of the extension pipe 31, the hook 38 of the clamp ring 37 is shrinked into engagement with the rib 33. Thus, the extension pipe 31 and the rail section 2*a* are combined in fluid tight communication therethrough. This embodiment has a technical advantage that an exchange of the seal members can be easily accomplished by detaching the clamp ring 37 for maintenance.

It is preferable to apply an adhesive of epoxy resin type to the engagement portions between the rail sections and the extension pipes. This kind of adhesive can provide connecting forces and also sealing properties therebetween. Further, it is most preferable to make the plastic sockets from a glass-fiber reinforced polyamide resin and to apply nickel coatings to the surfaces thereof. As a result of the specially prepared plastic materials and the nickel coatings, the sockets can resist against high temperature of the engine and also against an exposure to gasoline fuel.

Thus, as is apparent from the above description, the fuel delivery rail assembly of the present invention can provide technical advantages as follows:

(a) Since many kinds of working and transferring steps can be saved, the assembly becomes economical and easy to manufacture.

(b) Since a portion of the assembly is interchanged into a plastic part, the weight of the fuel delivery rail assembly is reduced, whereby a resultant weight of the engine becomes smaller.

(c) Since there remains a flexibility for the axial direction of the socket due to the resiliency of the connection portions, it becomes possible to make a practical adjustment between the socket and the injector.

I claim:

1. A fuel delivery rail assembly for an internal combustion engine comprising;

a plurality of sockets made from plastic materials, a plurality of rail sections made from metallic materials extending from said sockets, each of said sockets having a tubular body and a pair of extension pipes extending outwardly from the body toward opposite directions, interior surfaces of said tubular body being so formed as to receive a fuel injector, at least one end of each rail section being overlapped above or below said extension pipe with a seal member there-between, and means for combining said rail sections and said extension pipes.

2. A fuel delivery rail assembly as claimed in claim 1, further comprising a clamp ring located on each overlapped portion for holding said rail section and said extension pipe in its inside.

3. A fuel delivery rail assembly as claimed in claim 1, wherein each of said sockets is made from a glass-fiber reinforced polyamide resin and its surface is plated with nickel coating.

* * * * *